US008511646B1

(12) United States Patent
Woodard

(10) Patent No.: US 8,511,646 B1
(45) Date of Patent: Aug. 20, 2013

(54) ENGINE EXTRACTOR SYSTEM

(76) Inventor: Richard R. Woodard, Clearwater, FL (US)

( * ) Notice: Subject to any disclaimer, the term of this patent is extended or adjusted under 35 U.S.C. 154(b) by 280 days.

(21) Appl. No.: 12/931,526

(22) Filed: Feb. 3, 2011

(51) Int. Cl.
*B66D 1/36* (2006.01)

(52) U.S. Cl.
USPC ..... 254/338; 254/334

(58) Field of Classification Search
USPC ..... 254/323–325, 334, 338
See application file for complete search history.

(56) References Cited

U.S. PATENT DOCUMENTS 5,065,958 A * 11/1991 Stubstad et al. ..... 244/17.17
6,202,868 B1 * 3/2001 Murray ..... 212/294
6,499,610 B2 * 12/2002 Spitsbergen ..... 212/179
6,561,367 B2 * 5/2003 Eaton ..... 212/202
2009/0095944 A1 * 4/2009 Gaines ..... 254/334

* cited by examiner

*Primary Examiner* — Emmanuel M Marcelo
*Assistant Examiner* — Angela Caligiuri

(57) ABSTRACT

A coupling assembly separably couples a vertical support formed of an anchor pole, a vertical post and a mast to a helicopter. A top rail is pivotally coupled to an upper extent of the vertical support. A coupling plate is coupled to the vertical support. A winch is attached to the coupling plate. The top rail has ends with interior and exterior sheaves rotatably coupled to the ends of the top rail. A cable has a distal end positionable over an engine of the helicopter and adapted to be attached thereto. The cable has a proximal end attached to the winch for withdrawing and extending the cable.

2 Claims, 5 Drawing Sheets

ENGINE EXTRACTOR SYSTEM

BACKGROUND OF THE INVENTION

Field of the Invention

The present invention relates to an engine extractor system and more particularly pertains to hoisting and extracting an engine from a helicopter, the hoisting and extracting being done in a safe, convenient and economical manner.

SUMMARY OF THE INVENTION

In view of the disadvantages inherent in the known types of engine hoists of known designs and configurations now present in the prior art, the present invention provides an improved engine extractor system. As such, the general purpose of the present invention, which will be described subsequently in greater detail, is to provide a new and improved engine extractor system and method which has all the advantages of the prior art and none of the disadvantages.

To attain this, the present invention essentially comprises an engine extractor system. First provided is a helicopter. The helicopter has a main body portion. Provided below the main body portion are skids. Provided above the main body portion is an engine. The skids having raised, horizontally disposed transverse sections. The skids have downwardly extending legs. The skids have longitudinally extending feet below. A vertical support is provided. The vertical support has an upper vertical post above. The vertical support has a lower anchor pole below. The vertical support has a mast. The mast is provided intermediate the post and the pole. The post is slidably received on the mast. An upper bolt is provided. In this manner the post is coupled at a selected height with respect to the mast. The mast is slidably received on the pole. A lower bolt is provided. In this manner the mast is coupled at a selected height with respect to the pole.

A coupling assembly is provided. In this manner the vertical support is separably coupled to the helicopter. The coupling assembly includes an inverted U-shaped channel. The inverted U-shaped channel is attached to the pole. The inverted U-shaped channel is removably positioned over one foot of the skid. A foot bolt is provided. The foot bolt is threadedly coupled to the channel to contact and grip the one foot. A floating collar and pivot is provided. The floating collar and pivot is coupled to the pole adjacent to the channel. A stop collar is provided. The stop collar is coupled to the pole immediately above the floating collar and pivot. A nylon bearing is provided. The nylon bearing is coupled to the pole immediately above the stop collar. The nylon bearing provides a surface for rotatably supporting the mast. An anchor pole support member is provided. The anchor pole support member has an interior section. The anchor pole support member has an exterior section. The exterior section is slidably received on the interior section with holes and a securement pin. The exterior section has an exterior end. The exterior end has an adjustable tube clamp. The adjustable tube clamp is adapted to be separably coupled to a leg remote from the channel. The interior section has an interior end. The interior end has a pivotable clip. The pivotable clip attaches the floating collar and pivot to the anchor pole support member.

Further provided is a generally horizontal top rail. A pivot pin is provided. In this manner the top rail is pivotably coupled to an upper extent of the post. The top rail has a long section. The long section overlies the helicopter, including the engine and a central extent of the skid. The top rail has a short section. The short section extends from the post oppositely from the long section. A diagonal arm is provided. The diagonal arm has a lower section. The diagonal arm has an upper section. The upper section is slidably received in the lower section. The upper and lower ends have angularly aligned holes. A pin is provided. The pin is positionable in selected angularly aligned holes. In this manner the length of the diagonal arm may be varied. A mast anchor collar is provided. The mast anchor collar is slidably received on the post. The mast anchor collar and the post have vertically aligned holes. A pin is provided. The pin is positionable in the vertically aligned holes. In this manner the height of the mast anchor collar may be varied. A top rail pivot is provided. The top rail pivot is slidably received on the long end of the top rail. The top rail pivot and the top rail have horizontally aligned holes. A pin is provided. The pin is positionable in the horizontally aligned holes. In this manner the lateral position of the top rail pivot on the top rail may be varied Provided last is a winch assembly. The winch assembly has a pair of laterally spaced winch mounting plate collars. The winch mounting plate collars are secured to each other and to the mast. A coupling plate is provided. The coupling plate joins the collars. A winch with a hand crank is provided. The winch is attached to the coupling plate. The top rail has opposed ends. Interior and exterior sheaves are provided. The sheaves are rotatably coupled to the top rail at its ends. A flexible cable is provided. The flexible cable has a distal end. The distal end is positionable over the engine of the helicopter. The distal end is adapted to be attached thereto. The cable has a proximal end. The proximal end is attached to the winch. In this manner rotation of the hand crank will withdraw and extend the cable. Further in this manner the engine may be hoisted and extracted it from the body portion of the helicopter.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved engine extractor system which has all of the advantages of the prior art engine hoists of known designs and configurations and none of the disadvantages.

It is another object of the present invention to provide a new and improved engine extractor system which may be easily and efficiently manufactured and marketed.

It is further object of the present invention to provide a new and improved engine extractor system which is of durable and reliable constructions.

An even further object of the present invention is to provide a new and improved engine extractor system which is susceptible of a low cost of manufacture with regard to both materials and labor, and which accordingly is then susceptible of low prices of sale to the consuming public, thereby making such engine extractor system economically available to the buying public.

Even still another object of the present invention is to provide an engine extractor system for hoisting and extracting an engine from a helicopter, the hoisting and extracting being done in a safe, convenient and economical manner.

Lastly, it is an object of the present invention to provide a new and improved engine extractor system. A coupling assembly separably couples a vertical support formed of an anchor pole, a vertical post and a mast to a helicopter. A top rail is pivotally coupled to an upper extent of the vertical support. A coupling plate is coupled to the vertical support. A winch is attached to the coupling plate. The top rail has ends with interior and exterior sheaves rotatably coupled to the ends of the top rail. A cable has a distal end positionable over an engine of the helicopter and adapted to be attached thereto. The cable has a proximal end attached to the winch for withdrawing and extending the cable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
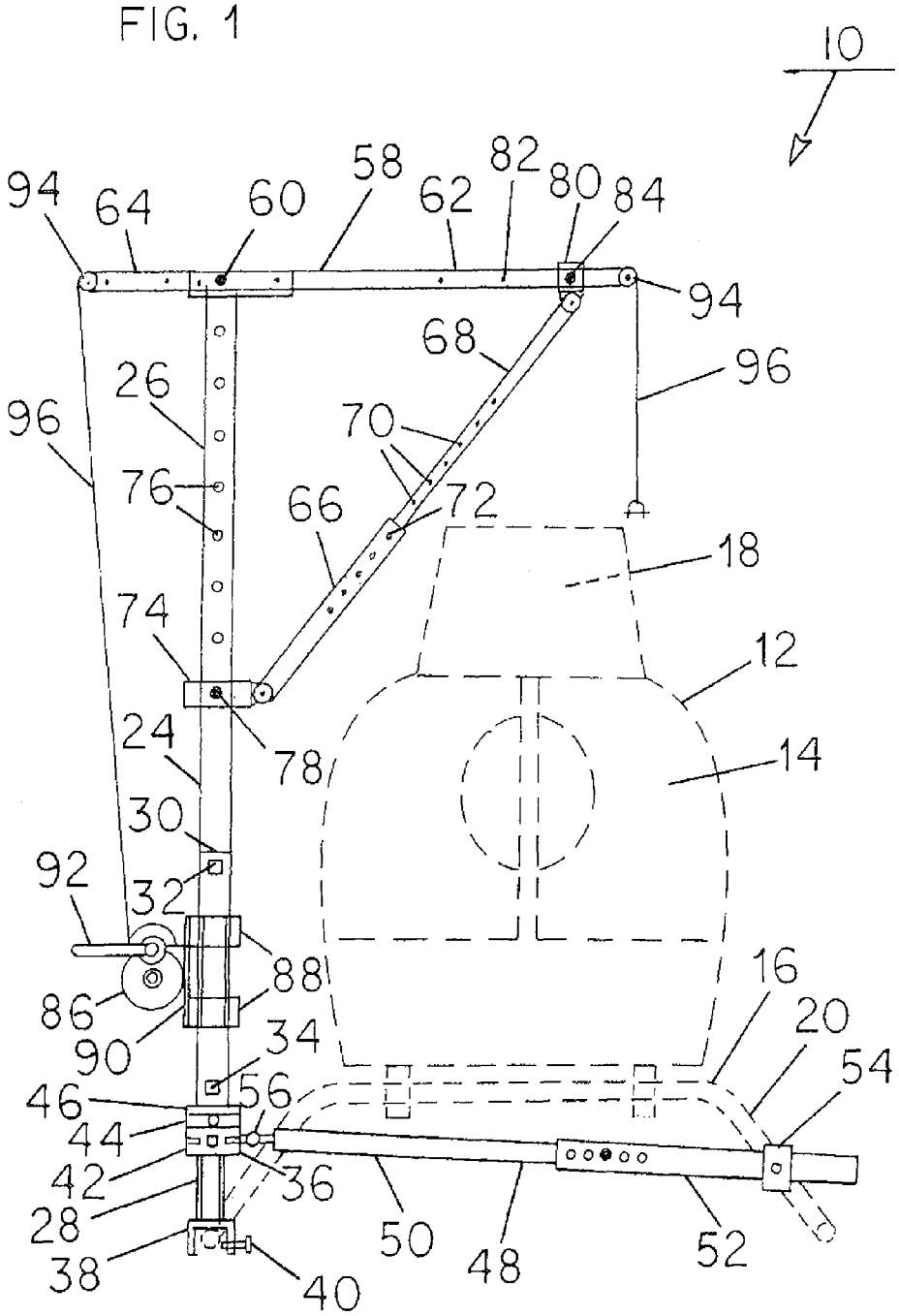
FIG. 1 is a side elevational view of an engine extractor system constructed in accordance with the principles of the present invention.
Figure 2:
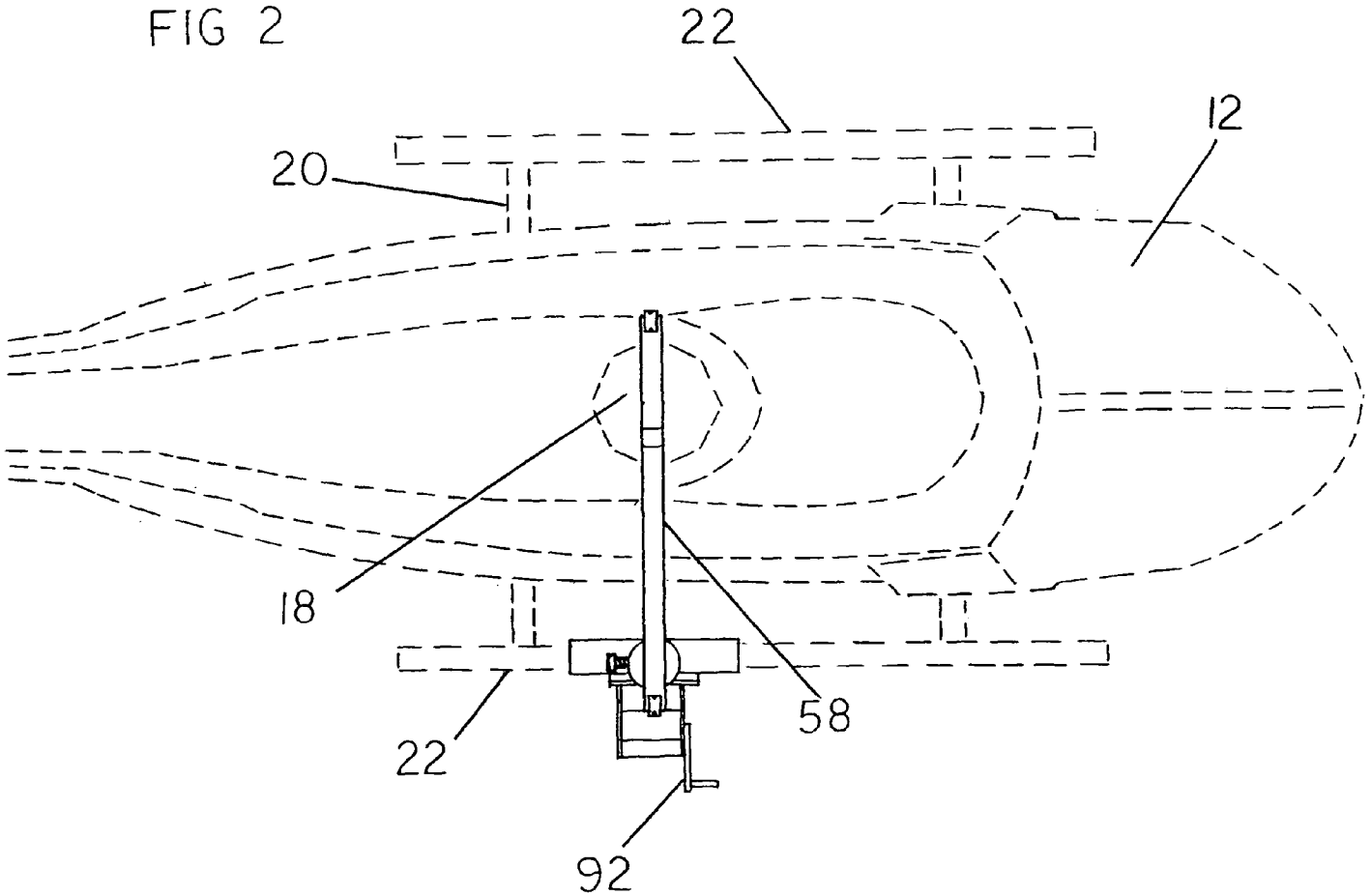
FIG. 2 is a plan view of the engine extractor system shown in FIG. 1.
Figure 3:
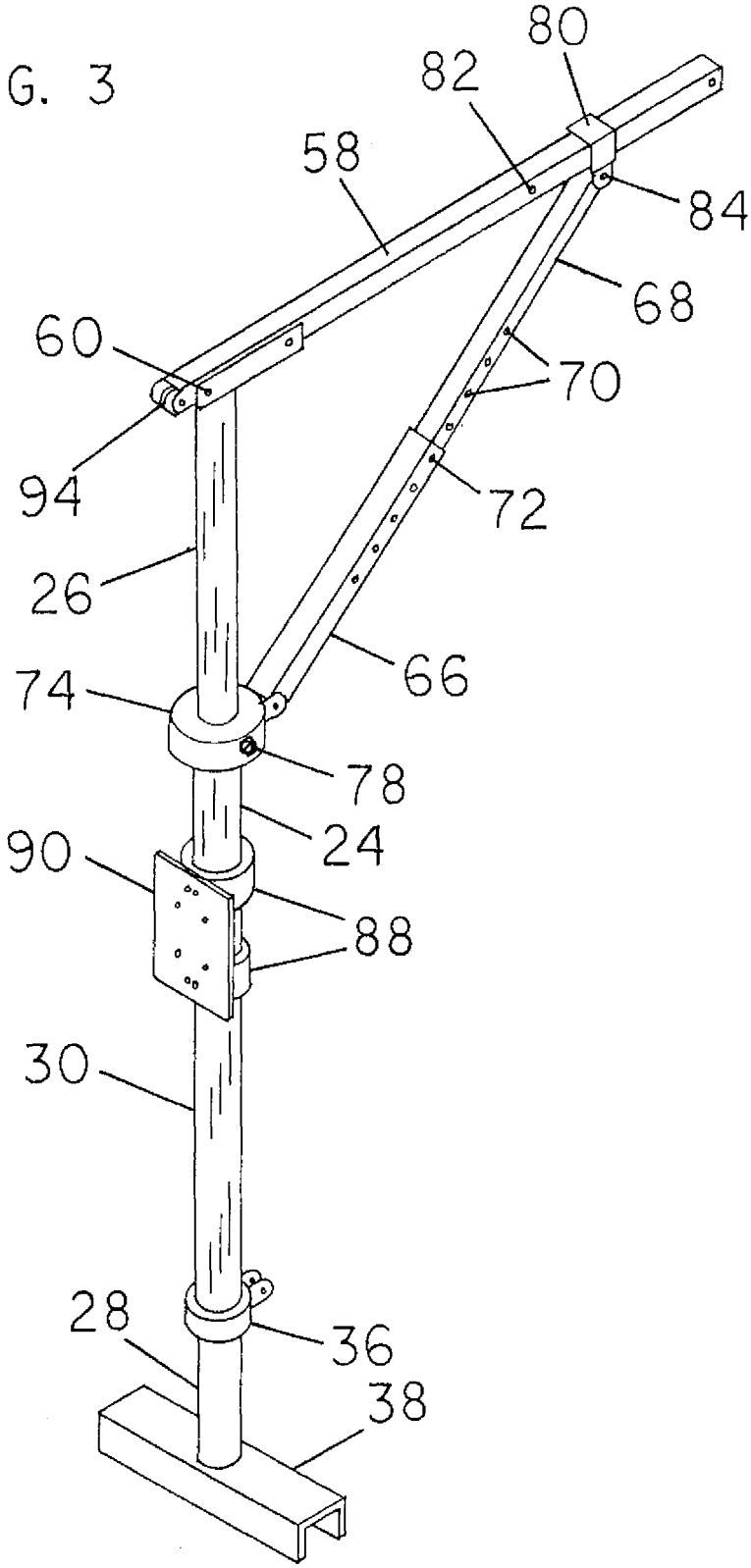
FIG. 3 is a rear elevational view of the engine extractor system of the prior Figures.
Figure 4:
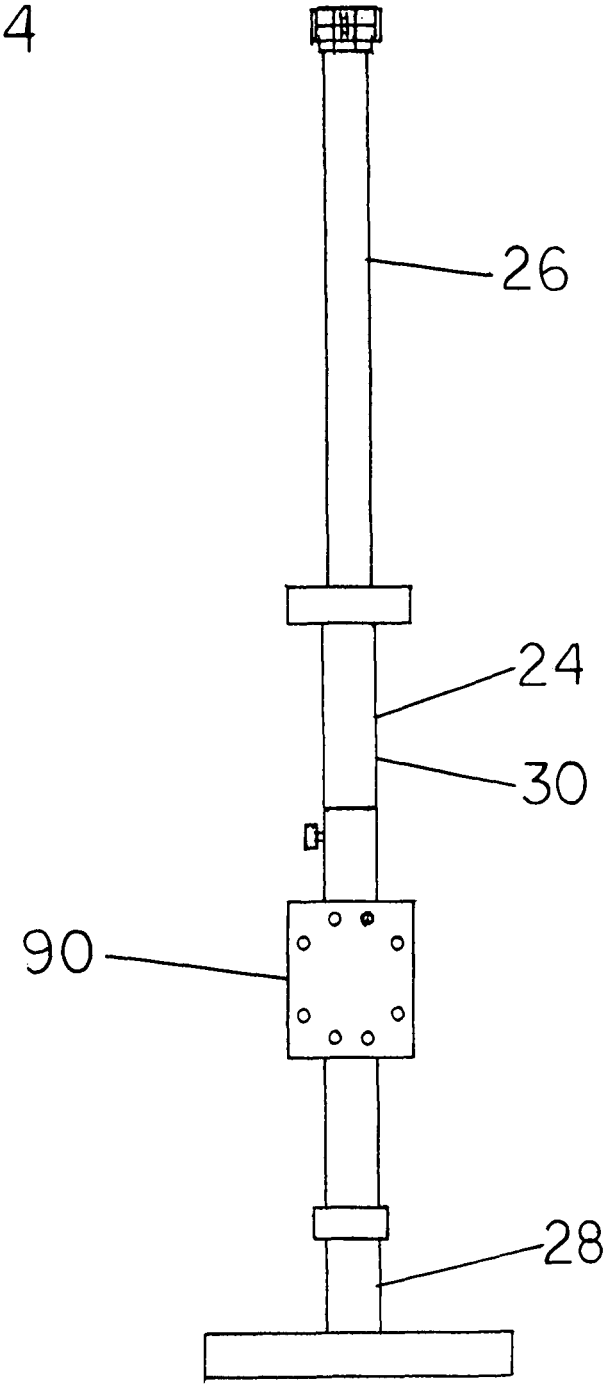
FIG. 4 is a perspective illustration of the engine extractor system of the prior Figures.
Figure 5:
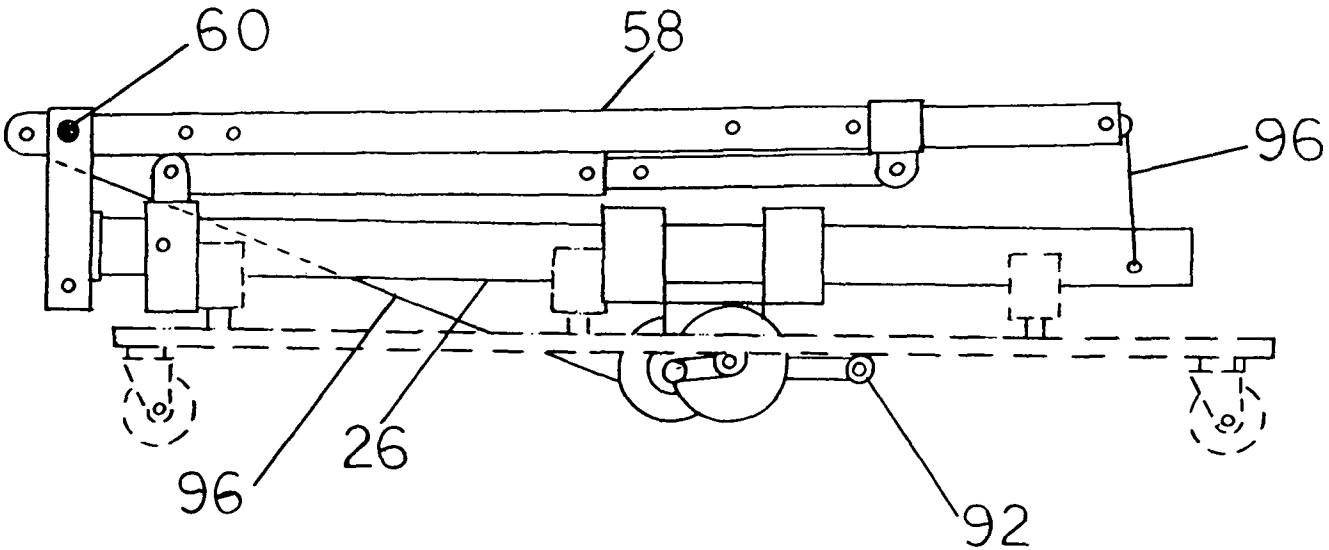
FIG. 5 is an enlarged side elevational of central components of the system shown in the prior Figures but in a folded orientation.

With reference now to the drawings, and in particular to FIG. 1 thereof, the preferred embodiment of the new and improved engine extractor system embodying the principles and concepts of the present invention and generally designated by the reference numeral 10 will be described.

The present invention, the engine extractor system 10 is comprised of a plurality of components. Such components in their broadest context include a vertical support, a coupling assembly, a top rail and a winch assembly. Such components are individually configured and correlated with respect to each other so as to attain the desired objective.

First provided is a helicopter 12. The helicopter has a main body portion 14. Provided below the main body portion are skids 16. Provided above the main body portion is an engine 18. The skids having raised, horizontally disposed transverse sections. The skids have downwardly extending legs 20. The skids have longitudinally extending feet 22 below.

A vertical support 24 is provided. The vertical support has an upper vertical post 26 above. The vertical support has a lower anchor pole 28 below. The vertical support has a mast 30. The mast is provided intermediate the post and the pole. The post is slidably received on the mast. An upper bolt 32 is provided. In this manner the post is coupled at a selected height with respect to the mast. The mast is slidably received on the pole. A lower bolt 34 is provided. In this manner the mast is coupled at a selected height with respect to the pole.

A coupling assembly 36 is provided. In this manner the vertical support is separably coupled to the helicopter. The coupling assembly includes an inverted U-shaped channel 38. The inverted U-shaped channel is attached to the pole. The inverted U-shaped channel is removably positioned over one foot of the skid. A foot bolt 40 is provided. The foot bolt is threadedly coupled to the channel to contact and grip the one foot. A floating collar and pivot 42 is provided. The floating collar and pivot is coupled to the pole adjacent to the channel. A stop collar 44 is provided. The stop collar is coupled to the pole immediately above the floating collar and pivot. A nylon bearing 46 is provided. The nylon bearing is coupled to the pole immediately above the stop collar. The nylon bearing provides a surface for rotatably supporting the mast. An anchor pole support member 48 is provided. The anchor pole support member has an interior section 50. The anchor pole support member has an exterior section 52 with holes and a securement pin. The exterior section is slidably received on the interior section. The exterior section has an exterior end. The exterior end has an adjustable tube clamp 54. The adjustable tube clamp is adapted to be separably coupled to a leg remote from the channel. The interior section has an interior end. The interior end has a pivotable clip 56. The pivotable clip attaches the floating collar and pivot to the anchor pole support member.

Further provided is a generally horizontal top rail 58. A pivot pin 60 is provided. In this manner the top rail is pivotably coupled to an upper extent of the post. The top rail has a long section 62. The long section overlies the helicopter, including the engine and a central extent of the skid. The top rail has a short section 64. The short section extends from the post oppositely from the long section. A diagonal arm is provided. The diagonal arm has a lower section 66. The diagonal arm has an upper section 68. The upper section is slidably received in the lower section. The upper and lower ends have angularly aligned holes 70. A pin 72 is provided. The pin is positionable in selected angularly aligned holes. In this manner the length of the diagonal arm may be varied. A mast anchor collar 74 is provided. The mast anchor collar is slidably received on the post. The mast anchor collar and the post have vertically aligned holes 76. A pin 78 is provided. The pin is positionable in the vertically aligned holes. In this manner the height of the mast anchor collar may be varied. A top rail pivot 80 is provided. The top rail pivot is slidably received on the long end of the top rail. The top rail pivot and the top rail have horizontally aligned holes 82. A pin 84 is provided. The pin is positionable in the horizontally aligned holes. In this manner the lateral position of the top rail pivot on the top rail may be varied.

Provided last is a winch assembly 86. The winch assembly has a pair of laterally spaced winch mounting plate collars 88. The winch mounting plate collars are secured to each other and to the mast. A coupling plate 90 is provided. The coupling plate joins the collars. A winch with a hand crank 92 is provided. The winch is attached to the coupling plate. The top rail has opposed ends. Interior and exterior sheaves 94 are provided. The sheaves are rotatably coupled to the top rail at its ends. A flexible cable 96 is provided. The flexible cable has a distal end. The distal end is positionable over the engine of the helicopter. The distal end is adapted to be attached thereto. The cable has a proximal end. The proximal end is attached to the winch. In this manner rotation of the hand crank will withdraw and extend the cable. Further in this manner the engine may be hoisted and extracted it from the body portion of the helicopter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An engine extractor system comprising:

a vertical support formed of an anchor pole and a vertical post and a mast;

a coupling assembly for separably coupling the vertical support to a helicopter;

a top rail pivotally coupled to an upper extent of the vertical support;

a coupling plate coupled to the vertical support, a winch attached to the coupling plate, the top rail having ends with interior and exterior sheaves rotatably coupled to the ends of the top rail, a cable having a distal end positionable over an engine of the helicopter and adapted to be attached thereto, the cable having a proximal end attached to the winch withdrawing and extending the cable; and wherein the coupling assembly includes an inverted U-shaped channel attached to the anchor pole and removably positioned over one foot of a skid of the helicopter with a foot bolt threadedly coupled to the channel to contact and grip the one foot, a floating collar and pivot coupled to the vertical support adjacent to the channel, a stop collar coupled to the anchor pole immediately above the floating collar and pivot, a nylon bearing coupled to the anchor pole immediately above the stop collar, an anchor pole support member formed of an interior section and an exterior section slidably received on the interior section, the exterior section having an exterior end with an adjustable tube clamp adapted to be separably coupled to a leg remote from the channel, the interior section having an interior end with a pivotable clip attaching the floating collar and pivot to the anchor pole support member.

2. An engine extractor system (10) for hoisting and extracting an engine from a helicopter, the system comprising, in combination:

a helicopter (12) having a main body portion (14) with skids (16) below and an engine (18) above, the skids having raised, horizontally disposed transverse sections with downwardly extending legs (20) and longitudinally extending feet (22) below;

a vertical support (24), the vertical support including an upper vertical post (26) above, a lower anchor pole (28) below and a mast (30) intermediate the post and the pole, the post being slidably received on the mast with an upper bolt (32) to couple the post at a selected height with respect to the mast, the mast being slidably received on the pole with an lower bolt (34) to couple the mast at a selected height with respect to the pole;

a coupling assembly (36) for separably coupling the vertical support to the helicopter, the coupling assembly including an inverted U-shaped channel (38) attached to the pole and removably positioned over one foot of the skid with a foot bolt (40) threadedly coupled to the channel to contact and grip the one foot, a floating collar and pivot (42) coupled to the pole adjacent to the channel, a stop collar (44) coupled to the pole immediately above the floating collar and pivot, a nylon bearing (46) coupled to the pole immediately above the stop collar, the nylon bearing providing a surface for rotatably supporting the mast, an anchor pole support member (48) formed of an interior section (50) and an exterior section (52) slidably received on the interior section with holes and a securement pin, the exterior section having an exterior end with an adjustable tube clamp (54) adapted to be separably coupled to a leg remote from the channel, the interior section having an interior end with a pivotable clip (56) attaching the floating collar and pivot to the anchor pole support member;

a generally horizontal top rail (58), a pivot pin (60) pivotally coupling the top rail to an upper extent of the post, the top rail having a long section (62) overlying the helicopter including the engine and a central extent of the skid, the top rail having a short section (64) extending from the post oppositely from the long section, a diagonal arm formed of a lower section (66) and an upper section (68) slidably received in the lower section, angularly aligned holes (70) extending through the upper and lower sections with an angular pin (72) positionable in selected angularly aligned holes to vary a length of the diagonal arm, a mast anchor collar (74) slidably received on the post with vertically aligned holes (76) in the mast anchor collar and the post with a vertical pin (78) positionable in the vertically aligned holes for varying a height of the mast anchor collar, a top rail pivot (80) slidably received on the long section of the top rail with horizontally aligned holes (82) in the top rail pivot and the top rail with a horizontal pin (84) horizontal positionable in the horizontally aligned holes for varying the lateral position of the top rail pivot on the top rail; and a winch assembly (86) including a pair of laterally spaced winch mounting plate collars (88) secured to each other and to the mast, a coupling plate (90) joining the collars, a winch with a hand crank (92) attached to the coupling plate, the top rail having opposed ends with interior and exterior sheaves (94) rotatably coupled to the top rail at its ends, a flexible cable (96) having a distal end positionable over the engine of the helicopter and adapted to be attached thereto, the cable having a proximal end attached to the winch whereby rotation of the hand crank will withdraw and extend the cable for hoisting the engine and extracting it from a body portion of the helicopter.

* * * * *